United States Patent [19]

Semon

[11] 4,118,878

[45] Oct. 10, 1978

[54] ARTICLE OF FOOTWEAR

[76] Inventor: William P. Semon, 27 Norgate Rd., Glen Head, N.Y. 11545

[21] Appl. No.: 836,952

[22] Filed: Sep. 27, 1977

[51] Int. Cl.[2] ..... A43B 23/28

[52] U.S. Cl. ..... 36/59 C; 36/8.1

[58] Field of Search ..... 36/59 R, 59 C, 8.1

[56] References Cited

U.S. PATENT DOCUMENTS

| | | | |
|---|---|---|---|
| 1,653,059 | 12/1927 | Nelson | 36/59 C |
| 3,043,025 | 7/1962 | Semon | 36/59 C |
| 3,237,322 | 3/1966 | Santore | 36/59 C |

*Primary Examiner*—Patrick D. Lawson

*Attorney, Agent, or Firm*—Kenyon & Kenyon, Reilly, Carr & Chapin

[57] ABSTRACT

Footwear including suction cups on the sole. Each cup includes a neck portion extending above the outsole and having a passage extending therethrough. A plurality of spacers are provided between the neck portions and extend thereabove. The spacers coact with a body presenting a surface bridging the spacers to seal and unseal the passages during walking.

10 Claims, 10 Drawing Figures

Figure 1:
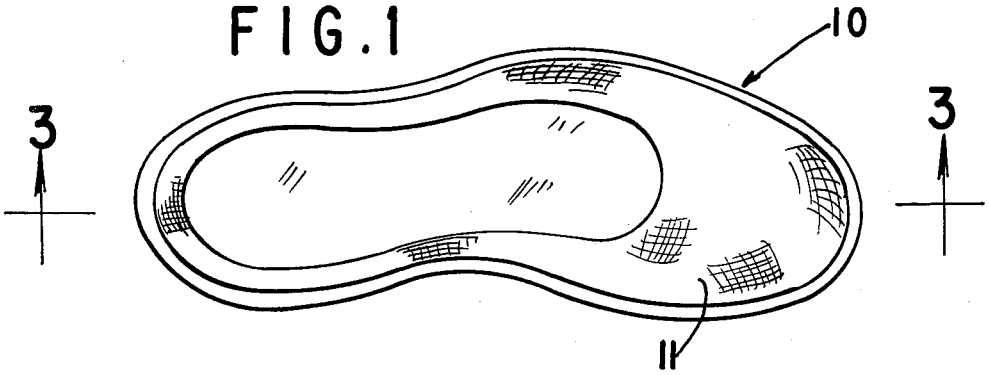

FIG. 4
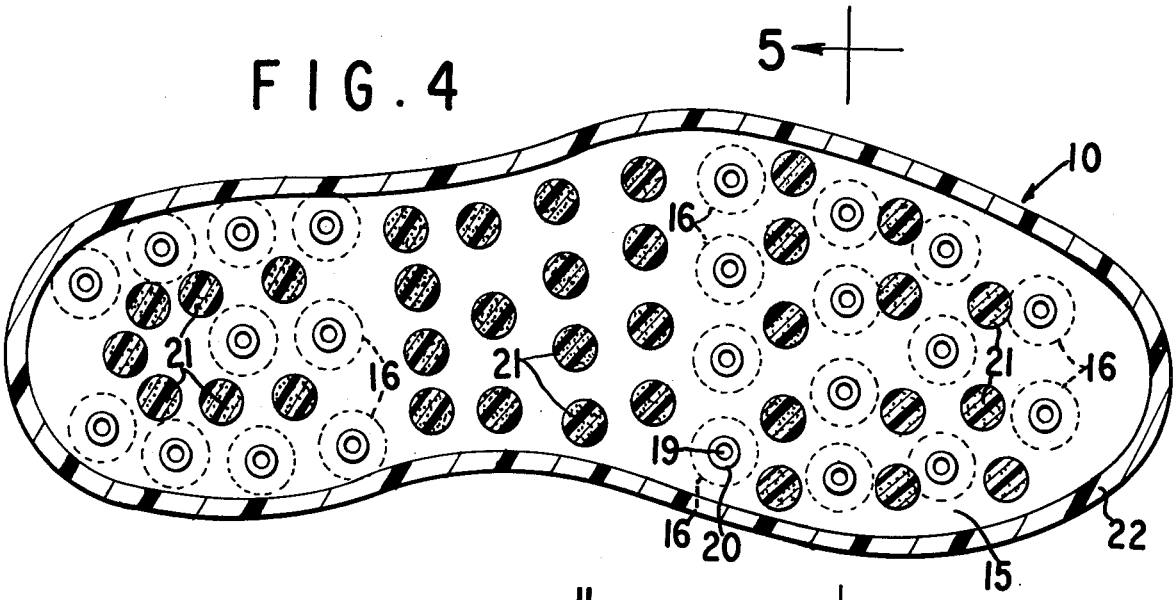
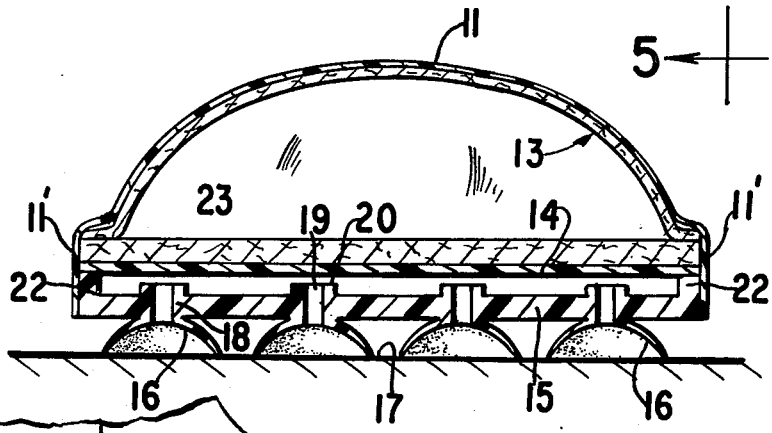
FIG. 5
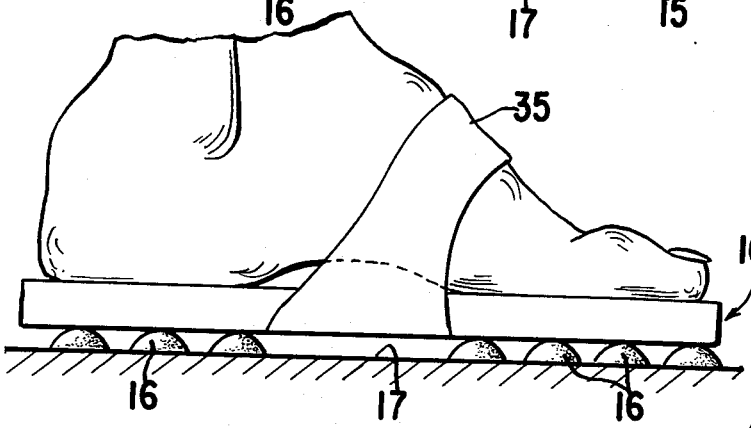
FIG. 6
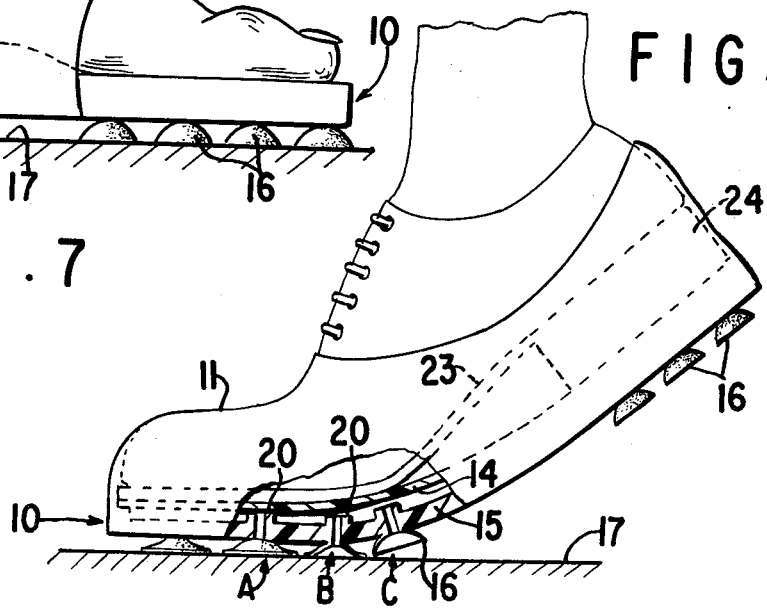
FIG. 7

ARTICLE OF FOOTWEAR

This invention relates to articles of footwear and relates more especially to improvements in articles of footwear that are provided with means for improving traction in the form of a plurality of suction cups depending from the sole thereof.

There are many situations wherein it is desirable to improve the traction or non-slip attribute of an article of foorwear so as to minimize slipping especially when the article of footwear is used when in contact with smooth surfaces. The playing surface for many athletic events such as basketball, handball, squash, bowling and the like is very smooth and the provision of secure traction on such surfaces is important. Good non-slip traction also is desirable for use on boats particularly in the case of pleasure craft where the occupants frequently walk on exposed decks. Footwear which minimizes slippage also is important in such occupations as building construction or wherever any danger due to the possibility of slipping desirably should be minimized as much as possible. Non-slip traction also is valuable in order to minimize accidents in bathtubs and showers.

In my U.S. Pat. No. 3,043,025 I have disclosed certain articles including an article of footwear provided with depending non-slip suction cups. The article of footwear disclosed in my prior patent is, however, attended with certain disadvantages and shortcomings which detract from its desirability as a commercial article of manufacture. In the article of footwear disclosed in my patent the sole portion is composed of two layers of resilient material that are bonded together throughout the lateral extent thereof except for a small cavity in the inner or upper layer in line with each suction cup which cavity has a depending conically-shaped valve element that cooperates with an opening through the lower or outer layer that communicates with the interior of the suction cup so as to seal said opening under imposed weight of the wearer. As thus constructed the sole is so stiff and inelastic as to necessitate the production of the article of footwear in various sizes after the manner of the production of ordinary shoes in a number of different sizes as regards length and width so as to provide a proper fit with the wearer. Another disadvantage of the embodiment shown in my prior patent is that the fabrication of the inner sheet with the cups and depending valve elements is excessively costly in relation to market salability especially when one also takes into consideration the above-mentioned necessity for making the footwear in a very substantial number of different sizes for sale to the general public.

There is need for the provision of an article of footwear which has the advantage of good traction provided by suction cup means and which is of light weight and which can be manufactured at a low cost. It is an object of this invention to provide such an article of footwear.

It also is an object of this invention to provide an article of footwear of the character above-mentioned the sole of which is so flexible and elastic as to enable a given size of the article of footwear to be readily accommodated for application to feet and shoes which vary quite widely in size.

It also is an object of this invention to provide an article of footwear that has sufficient flexiblity, elasticity and adaptability so that it can be applied readily either directly to the foot of the wearer or to some other article of footwear such as a shoe or a sneaker. For example, for use in athletic contests and sports which take place on smooth surfaces footwear such as conventional sneakers may have their non-slip traction with the playing surface improved by the attachment of the footwear of the present invention so as to underlie the sole of the sneaker, there being holding means attached to the sole of the footwear embodying this invention such as an elastic slip-on upper which borders the sole and which permits the non-slip sole to be readily engaged with and then disengaged from the sneaker. Good traction also is to be desired whenever sure footing is important as for example in the case of construction workers during the erection of structures such as skyscrapers and bridges. By way of further example the article of footwear of this invention also is desirable for use on boats for attachment to conventional footwear or directly to the feet of the wearer so as to improve traction with boat decks or passageways in the case of both pleasure craft and larger vessels including submarines and aircraft carriers. It also is of utility in providing non-slip footing in a bathtub or shower or on terrazzo or waxed floors. Especially when the holding means for holding the footwear in place is in the form of a strap that overlies the instep, the footwear of this invention provides a convenient and inexpensive expedient for minimizing the risk of slipping in a bathtub or in a shower. For example, the footwear of this invention lends itself to being furnished by motels and hotels as a standard item in bathrooms since a single article of footwear embodying this invention, because of the nature of its construction, has the ability to be accommodated to guests whose foot sizes may vary over a considerable range.

The article of footwear of this invention comprises a sole and holding means that is secured to the sole and that is adapted for ready engagement with and disengagement from the foot of a human or a shoe worn on the foot of a human. According to the improvement of this invention the sole of the article of footwear comprises a sheet of flexible elastic material having secured thereto a plurality of flexible resilient suction cups that depend from the undersurface of the sheet. When reference is made herein to the use of a suction cup it is to be understood that this term is used in the conventional manner as applicable to any hollow cup-shaped body made of flexible resilient material presenting a rim which when pressed against a surface tends to be retained due to the development upon attempted removal of the cup of subatmospheric pressure which resists removal by maintaining suction that tends to maintain the cups held against the surface in contact therewith. Each suction cup comprises a neck that extends through the sheet so as to protrude substantially above the upper surface of the sheet and that has a hollow passage extending therethrough. The neck portion of the suction cup may be integral with the sheet or may be separately fabricated and secured to the sheet as by the use of an adhesive. The upper extremity of the neck presents a surface adapted to provide a seal with a surface brought into pressure contact therewith that seals the upper end of the hollow passage. The sheet has upstanding therefrom in substantially laterally spaced relation to said necks a plurality of spacer bodies that are in secured relation to said sheet. The upper surfaces of the spacer bodies are spaced from the upper surface of the sheet to an extent that is substantially greater than the spacing of the upper extremities of said necks from the upper surface of the sheet.

When the upper surface of said sheet that presents said spacer bodies and the protruding upper extremities of said necks is subjected to pressure by a body that presents a surface bridging the spacer bodies until said surface is brought into sealing contact with the upper extremities of the necks the suction cups are in condition to perform their function as suction cups in providing improved traction with surface against which the suction cups may be pressed. Preferably the spacer bodies are composed of resilient compressible material in that sealing contact may be more readily accomplished. However, if the body that presents the surface brought into contact with the upper extremities of the necks is sufficiently flexible and resilient, such as the sole of a bare human foot, the flexibility of the body itself will be adequate for enabling the sealing contact to be established. In either case, when the applied pressure is relieved, the spacer bodies tend to induce the separation of the surface from the upper extremities of the necks with attendant rupturing of the seal between the surface and the hollow passage in the necks thereby immediately releasing any suction created in the suction cups and any tendency to cling to a surface facing the suction cups.

When the article of footwear of this invention is primarily intended to be worn over a shoe or sneaker, the sole of the article preferably additionally comprises an inner sheet of flexible sheet material that overlies and is supported by and secured to the upper surfaces of the spacer bodies. In such case it is the undersurface of the inner sheet that presents the surface that seals the open passages in the necks of the suction cups when it is pressed against the upper extremities of the necks. When the sole of the article of footwear is made comprising an inner sheet of flexible resilient material in combination with the outer sheet comprising the suction cups the spacer bodies may be composed of compressible resilient material such as soft rubber or urethane foam which normally maintains the upper surface of the outer sheet in spaced relation to the undersurface of the inner sheet with the surfaces that are presented by the necks of the suction cups at their upper extremities where they protrude from the upper surface of the outer sheet in proximate opposed spaced relation to areas of the undersurface of the inner sheet. The spacer bodies are sufficiently compressible to permit said areas of the undersurface of the inner sheet to be brought into pressure contact with the aforesaid surfaces presented by the necks of the suction cups when the spacer bodies are subjected to pressure imposed by the wearer of the footwear. The spacer bodies also are sufficiently resilient in relation to the resistance to flexure of said inner and outer sheets to cause said areas of the undersurface of the inner sheet to become separated from the surfaces presented by the necks of the suction cups when the pressure imposed by the wearer is relieved. The upper surfaces presented by the necks and said areas of the undersurface of the inner sheet when brought together under pressure imposed by the wearer of the footwear form a substantially airtight seal so long as the pressure imposed by the wearer is imposed on the spacer bodies between the two sheets. The spacer bodies may be provided in a number of different forms and while they may be integral with either the inner or outer sheet they preferably are composed of a different material that is more readily compressed than the material of either sheet. The spacer bodies are located at spaced intervals adapted to receive the weight of the wearer distributed among them and are sufficiently spaced from each other to permit manual flexure and stretching of the sole in the portions of the inner and outer sheets that bridge the spaces between the spacer bodies. By this construction a high degree of flexibility and of stretchability in all directions for the entire sole portion of the footwear is provided such that by simple manual manipulation a given size of the article of footwear may be easily applied directly to the foot of the wearer or to a shoe or sneaker worn by the wearer over a wide range of different sizes of feet and of sneakers or shoes. The aforesaid construction also is of advantage in that the air space between the inner and outer sheets may be of a large volume so that when the suction cups are pressed against the surface air may be readily discharged into the chamber until the seal is formed between the undersurface of the inner sheet and the surfaces presented by the necks of the suction cups. This enables a maximum suction effect to be obtained since the air content of the suction cups is more effectively diminished with corresponding enhancement of suction upon attempt to separate the cups from a surface that is in contact with the rim of cups. It also is the case that there is an ample supply of air so that when the seal between the undersurface of the inner sheet and the surface as presented by the necks is broken the suction is immediately and quickly relieved. The result is that very effective anti-slip traction is provided when the weight of the wearer is imposed on the sole but that there is a very quick release of the suction so that when the foot of the wearer is being lifted there is no tendency to cling to the surface in contact with the rims of the cups. In preferred embodiments the spacer bodies occupy not more than about 50% of the space between the inner and outer sheets.

The securing means by which the sole is secured when being worn also may be made of highly flexible elastic sheet material which can be easily stretched manually and which will resiliently enable the article of footwear to be held in place on the foot of the wearer or on a shoe or sneaker worn by the wearer notwithstanding substantial differences in size. Normally the article of footwear of this invention is composed of a natural or synthetic rubber which has been formulated and vulcanized in accordance with practices that are conventional in the art to provide an appropriate combination of structural strength and elasticity for accomplishing the objectives and for providing the advantages herein described. The weight and strength of the material used will, of course, vary to some extent depending on the intended utility. Thus, for a light weight very easily stretchable article the sheet material used would ordinarily be quite thin, e.g., of the order of 1/32 inch in thickness and would be easily stretched to the extent of at least about 20% of its normal dimensions. Moreover, for such use the suction cups would ordinarily be relatively small such as about $\frac{3}{8}$ to $\frac{1}{2}$ inch in diameter. For heavy duty usage, such as for use by construction workers, a heavier construction would be more suitable such as sheet material about 1/16 inch in thickness or greater so long as sufficient elasticity is provided to enable the article of footwear to be slipped over a conventional shoe, for example. For any such use suction cups of larger size and less in number would ordinarily be provided in order to afford a firm grip under the conditions encountered in this type of work. For use in connection with games played on smooth surfaces the weight of material and the suction cup size would normally fall in an intermediate zone. More generally, it is to be understood that the foregoing is merely illustrative and that any particular selection would be largely a matter of preference.

Especially when the article of footwear of this invention is to be worn on the bare feet of the wearer it is not necessary to include the inner sheet in the sole. In fact, it usually is preferable to omit the inner sheet when the article of footweare is intended primarily for use in a bathroom to minimize danger from slipping in a tub or shower. In such case the surface presented by the sole of the bare foot has the same function as the undersurface of the inner sheet as regards ability when pressed against the upper extremity of a suction cup to close off and seal the passage through the neck. Regardless of the resiliency of the spacer bodies that are employed the flexibility of the sole of the bare human foot is ample, when under pressure, to make sealing contact with the upper extremities of the necks. When, however, weight is removed the spacer bodies serve to separate the neck extremities from the sole of the foot. When producing this embodiment of the invention it normally is expedient to form the entire sheet including the suction cups and the spacer bodies in a single operation. Preferably, at the same time a beading is provided bordering the margin of the sole. In either case all that remains to complete the article of footwear is the attachment of a hold-on upper such as a strap that passes over the instep or a thong that can be slid in between the great toe and next adjoining toe.

Figure 2:
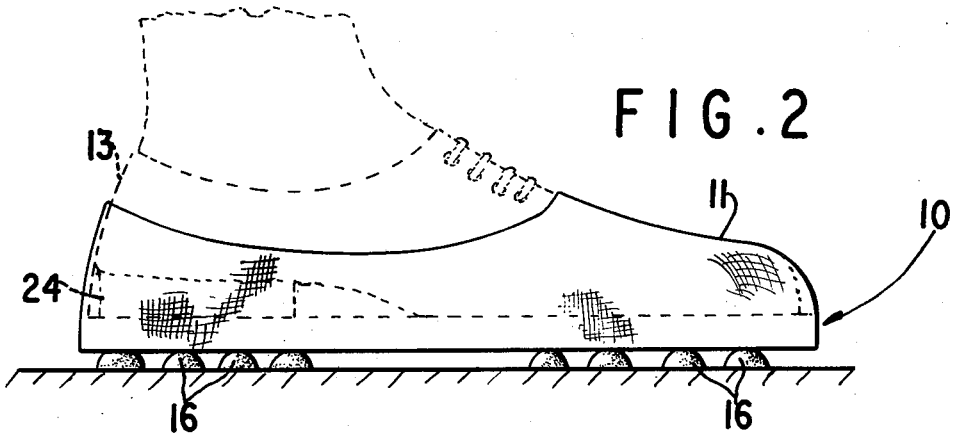
Figure 3:
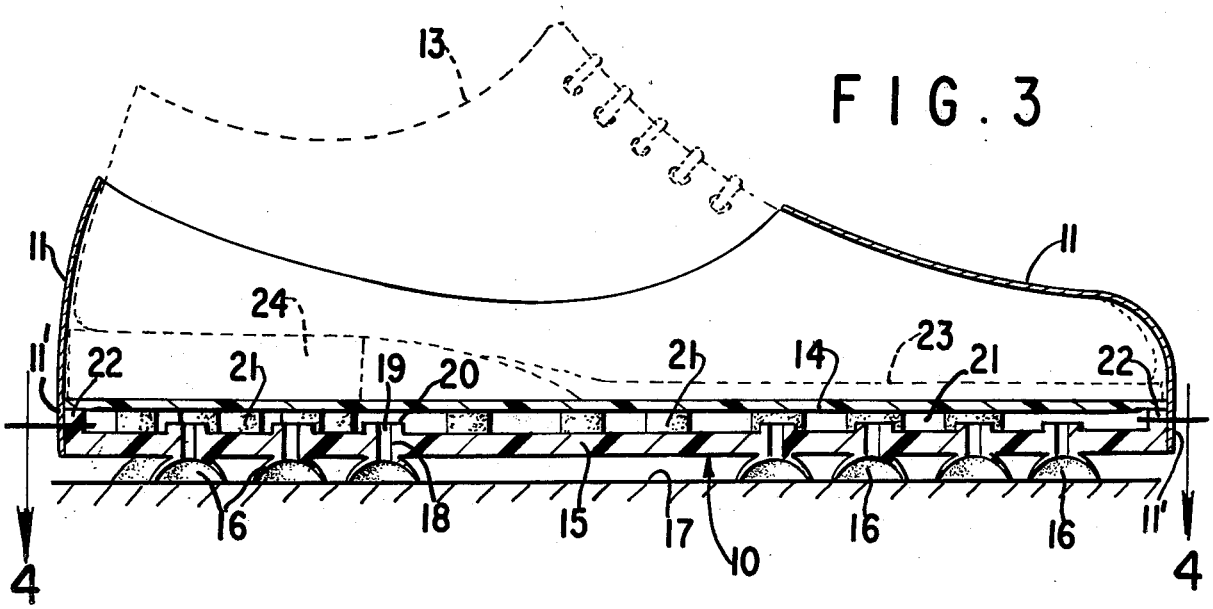
Figure 8:
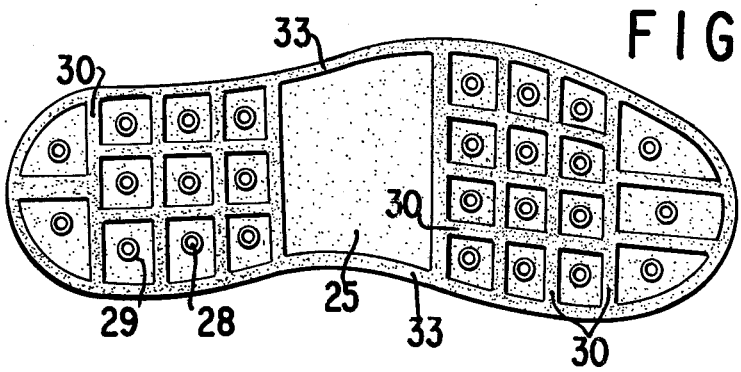
Figure 9:
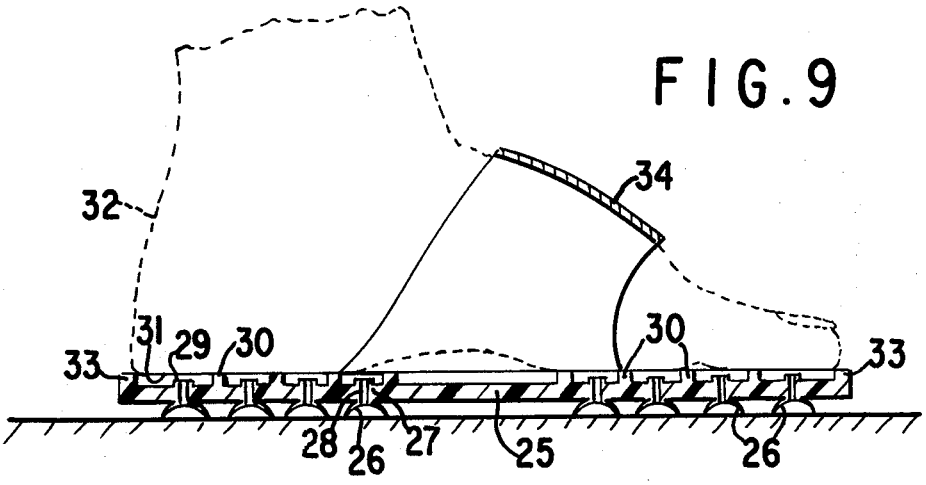
Figure 10:
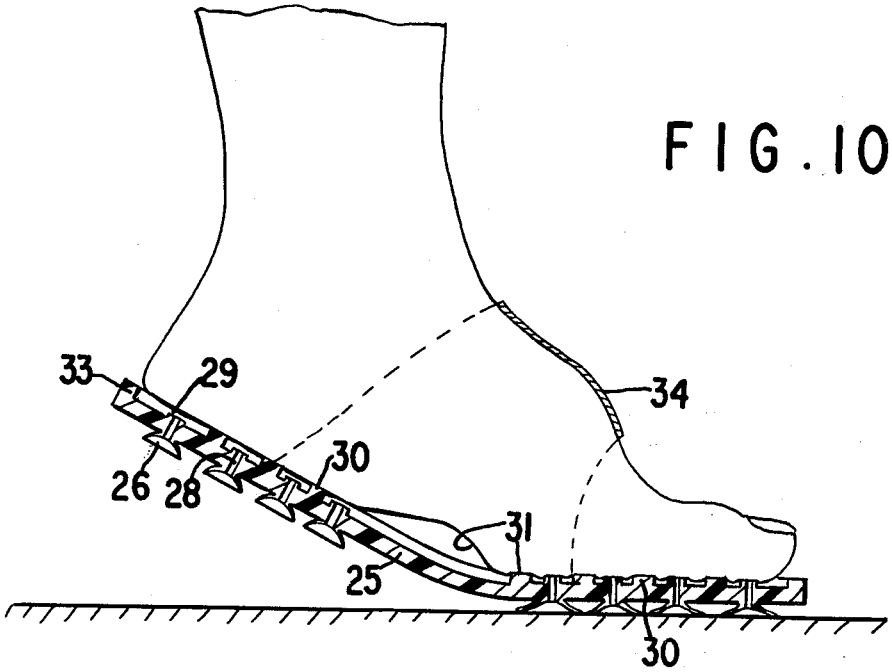

Further objects and features of this invention will become apparent in connection with the following description of the article of footwear of this invention as shown for illustrative purposes in the accompanying drawings wherein:

FIG. 1 is a plan view of a typical embodiment of this invention wherein the sole comprises an inner sheet as well as the outer sheet comprising the suction cups, FIG. 2 is a side elevation of the embodiment shown in FIG. 1 as supplemented by the dotted line indicating securement to a shoe, FIG. 3 is a section on a somewhat larger scale taken in the line 3—3 of FIG. 1, the sole elements being in their relative relation to each other assumed when the weight of the wearer is not imposed thereon, FIG. 4 is a section taken in the line 4—4 of FIG. 3, FIG. 5 is a section on a still larger scale taken in the line 5—5 of FIG. 4, FIG. 6 is another view of the article of footwear shown in FIGS. 1-5, the sole elements being in their relative relation to each other assumed when the weight of the wearer is imposed thereon in the region of the ball of the foot and is being removed as the heel is being lifted, FIG. 7 is a side elevation similar to that shown in FIG. 2 when provided with alternative holding means for holding the article of footwear on a human foot, FIG. 8 is a plan view of the sole portion of the simpler embodiment of this invention which does not comprise the inner sheet of the embodiment shown in FIGS. 1-7, FIG. 9 is a longitudinal sectional elevation of the sole shown in FIG. 8 in combination with holding means for holding it underneath the sole of a bare human foot, and FIG. 10 is similar to FIG. 9 but illustrates the effect of applied pressure and release of applied pressure under the influence of the sole of the human foot.

In the embodiment of this invention that is shown in FIGS. 1-6 the sole of the footwear is indicated generally by the reference character 10. In the embodiment shown in FIGS. 1-6 the sole is bordered by a slip-on upper 11 whch, as aforesaid, preferably is made of highly elastic material such as rubber and which provides one form of holding means for enabling the article of footwear to be readily engaged with or disengaged from the foot of a human or a shoe. In FIGS. 2 and 3 the footwear is shown in relation to the shoe 13 of the wearer that is indicated by dotted lines and that comprises the sole 23 and the heel 24.

The sole of the article of footwear of this invention comprises the inner sheet 14 and the outer sheet 15. Each of these sheets preferably is made of flexible elastic material such as rubber which enables each of these sheets either individually or in combination as shown to be substantially stretched so that the article of footwear may be accommodated to feet or shoes of widely different sizes as regards length and width. A plurality of conventional suction cups 16 depend from the undersurface of the outer sheet 15 which are made of a suitable flexible and resilient material such as rubber. The suction cups are distributed in a regular manner so as to be in those areas of the sole that are principally subjected to the weight of the wearer and they are distributed so that the suction effect will occur substantially uniformally throughout the areas which are subjected to the weight of the wearer. Each of the suction cups comprises a neck portion 18 having a hollow passage 19 therethrough. The upper extremity 20 of the neck portion 18 protrudes from the upper surface of the outer sheet 15 so as to provide an annular surface in opposed relation to an area of the undersurface of the inner sheet 14.

When the weight of the wearer is not imposed on the sole, the inner sheet 14 and the outer sheet 15 are maintained in spaced relation with respect to each other as shown in FIGS. 3 and 5 by a plurality of spacer bodies 21 which are located in a regular manner at spaced intervals distributed for receiving the weight of the wearer among them. While the spacer bodies are shown as disc-shaped, they could be of other shapes such as oblong, square or other shape. The spacer bodies 21 are composed of a resilient material such as a soft rubber or polyurethane foam which normally maintains the desired spacing between the inner and outer sheets but which permits areas of the undersurface of the inner sheet 14 to come into pressure contact with the surface presented by the upper extremities 20 of the necks of the suction cups when the inner sheet is subjected to the weight of the wearer. The surface areas which are thus brought into pressure contact imposed by the weight of the wearer are such as to provide an air seal at the upper extremity of the necks of the suction cups. By this construction pressure of the suction cups against a surface such as the surface 17 initially causes discharge of air through the passages 19 in the necks of the suction cups into the air space provided between the sheets 14 and 15 until the undersurface of the inner sheet comes into air-sealed contact with the upper extremities 20 of the necks of the cups. In this way desirable collapsing effect in the several cups is accomplished whereby an effective seal is maintained with the surface 17 due to the resilient tendency of the cups to assume their normal configuration and thereby provide a suction effect. When the pressure applied by the wearer to the inner sheet is relieved the seal between the undersurface of the sheet 14 and the extremities 20 of the necks 18 is immediately broken so as to permit an inrush of air whereby the suction effect of the cups is relieved virtually instantaneously so that there will be no tendency of the footwear to cling to the surface against which the cups have been compressed when the applied pressure is relieved. To this end, while the sheets 14 and 15 are composed of flexible and elastic material which facilitates overall flexure and stretching of the sole of the footwear, the sheets 14 and 15 desirably should have sufficient resistance to flexure so that as soon as the weight of the wearer is removed from the upper surface of the inner sheet the resulting expansion of the spacer bodies will be promptly accompanied by separation of the terminal surfaces of the necks from the areas of the undersurface of the inner sheet in contact therewith thereby relieving the suction. Moreover, it is one of the structural advantages of the invention that the spacer bodies between sheets 14 and 15 are distributed so as to provide an air space between the two sheets which is of substantial extent. Since the spacer bodies are not connected to each other and are substantially spaced from the necks of the suction cups there is freedome of movement of the air within the space between the two sheets.

In FIG. 6 the elements of the sole are shown in their relative positions when the weight of the wearer is imposed on the suction cups in the region of the ball of the foot, the upper extremity 20 of the neck of one of the cups at position A being shown pressed against the underside of the inner sheet 14 to form an airtight seal between them. At position B the underside of the inner sheet is shown just as it begins to become separated from the upper extremity 20 of the cup neck with rupture of the air seal responsive to the expansion force of the spacer bodies as the weight of the wearer begins to be relieved. At position C the underside of the inner sheet 14 has assumed its normal proximate spaced relation with respect to upper extremity 20 of the neck of the suction cup.

Another important advantage of employing spaced spacer bodies that are not connected with each other is that of obtaining capability of the sheets 14 and 15 to be stretched and flexed in the regions of the spaces between the spacer bodies. By such construction an article of footwear may be provided which can be folded or rolled up to be carried in one's pocket or may be available in locker rooms for use merely by stretching so as to accommodate any of a wide variety of foot and shoe sizes.

The sheets 14 and 15 are held in spaced relation to each other throughout their peripheries preferably by the production of the outer sheet with the integral bordering beading 22 although, if desired, the beading 22 could be produced integrally with the inner sheet or could be produced from some other material such as that used for the spacer bodies 21. As is conventional, the interfaces between the sheets 14 and 15 with the spacer bodies 21 and the beading 22 would ordinarily be secured together by a suitable adhesive cement.

The article of footwear may be readily produced in different ways. Preferably, by known molding techniques, the outer sheet, including the suction cups and the beading 22, is provided by a single molding operation. Thereafter the upper sheet and spacer bodies are assembled therewith and cemented in place. The margin 11' of the upper may be brought down so as to overlie the margins of the sheets 14 and 15 and cemented in place by an adhesive. Alternatively, the outer sheet may be made complete with the spacer bodies as well as the suction cups by a single molding operation. Another expedient for securing the upper to the sole consists in molding the outer sheet not only with the border beading 22 but also with a rim upstanding from the beading to which the upper 11 is secured by a suitable cement. Another suitable production expedient consists in forming the slip-on upper with a peripheral flange that may flare either inwardly or outwardly and cementing face down to the upper surface of the inner sheet 14.

Another embodiment of this invention is shown in FIG. 7. This embodiment is the same as that hereinabove described except that the holding means is shown holding the sole underneath the sole of a human foot and except that the holding means instead of being in the form of a slip-on upper that borders the periphery of the sole is in the form of a holding strap 35 that goes over the instep and that is composed of flexible elastic material such as rubber which may be secured to the sole in any of the ways hereinabove described in connection with the embodiment of FIGS. 1–6. The remaining reference characters shown in FIG. 7 have the same applicability as the same reference characters do in FIG. 2.

For use as an anti-slip foot covering used in bathrooms for preventing accidental slipping in a bathtube or shower the simpler embodiment of this invention shown in FIGS. 8, 9 and 10 is preferred both because its lighter weight and greater stretchability lends itself better to such use and because it can more readily be mass produced at low cost. This embodiment comprises the sheet of flexible resilient material 25 which is generally similar to the outer sheet 15 of the embodiment shown in FIGS. 1–7. The suction cups 26 comprising the necks 27 which have the hollow passages 28 passing therethrough and the upper extremities 29, the surfaces which are substantially spaced from and above the upper surface of the sheet 15, also are generally similar to the corresponding elements of the embodiment shown in FIGS. 1–7.

In the embodiment shown in FIGS. 8–10 the spacer bodies are shown in the form of ribs 30 which ordinarily are formed integrally with the sheet 15 as a matter of economy although they may be made separately from the same or a different material and cemented in place. The spacer bodies may be provided in any way that is effective and consistent with the comfort of the wearer. In the embodiment shown in FIGS. 8–10 the rib pattern is consistent with the comfort of the wearer and likewise is consistent with permitting the sole 31 of the bare human foot 32 to make contact with the upper extremities 29 of the necks of the suction cups since the sole of a human foot under the pressure of body weight is sufficiently flexible to permit the portions that bridge the spacer bodies to come in contact with the neck extremities and seal the open passages in the necks as indicated in the region of the ball of the foot in FIG. 10. When, however, the pressure is relieved as indicated in FIG. 10 in the region of the heel, the spacer bodies act to ensure immediate separation from the extremities of the suction cups with resulting rupture of the seal which, if retained, would have the undesirable effect of causing the sole of the footwear to cling to the surface against which the cups had been pressed. Of course, in any case whether the inner sheet is present or not the spacer bodies should be sufficiently spaced to permit sealing under applied pressure.

In order to provide improved appearance and better structural integrity the sheet 25 of the embodiment shown in FIGS. 8–10 is bordered by a beading 33 which when it occurs cooperates with the ribs 30 in affording a portion of the spacer bodies which have the function hereinabove described. The beading 33 also provides better anchorage for cementing in place the strap 34 which extends over the instep to provide the hold-on. The embodiment of this invention shown in FIGS. 8–10 also lends itself admirably to a hold-on in the form of a thong secured to the sheet 25 which is adapted to pass between the great toe and the next adjacent toe.

The embodiment of FIG. 8–10 is especially suited to mass production by a simple stamping or molding operation wherein the sole is formed in a single operation ready for the attachment of a hold-on.

I claim:

1. In an article of footwear that comprises a sole and readily engageable and disengageable holding means for holding said sole underneath the sole of a human foot or of a shoe worn on the foot of a human, said sole presenting a plurality of suction cups depending from the bottom of said sole for improving the non-slip traction of said sole with respect to a surface against which said suction cups may be pressed, the improvement in that said sole of said footwear comprises an outer sheet of flexible elastic material, a plurality of flexible resilient suction cups secured to said sheet with said cups depending from the undersurface of said sheet, each of said cups comprising a neck that extends through said outer sheet so as to protrude substantially above the upper surface of said outer sheet and has a hollow passage extending therethrough, an inner sheet of flexible elastic material above said outer sheet, a plurality of spacer bodies which normally maintain the undersurface of said inner sheet in secured spaced relation with respect to the upper surface of said outer sheet and with the surfaces of said necks presented at their upper extremities in proximate opposed spaced relation to areas of the undersurface of said inner sheet that are in opposed relation to said necks, said spacer bodies being sufficiently compressible to permit bringing said areas of the undersurface of said inner sheet into pressure contact with said surfaces presented by said necks when said bodies are subjected to pressure imposed by the wearer of the footwear and likewise being sufficiently resilient in relation to the resistance to flexure of said sheets to cause said areas of said undersurface presented by said inner sheet to become separated from said surfaces presented by said necks when said pressure is relieved, said surfaces presented by said necks and said areas of the undersurface of the inner sheet being effective to form a substantially airtight seal therebetween when brought into pressure contact relation by the wearer of the footwear imposing pressure on the upper surface of said inner sheet as he brings said suction cups into pressure contact with an underlying surface, said spacer bodies being localized at spaced intervals adapted to receive the weight of the wearer distributed among them and being sufficiently spaced from each other to readily permit substantial manual stretching and flexure of said sole in the portions of said inner and outer sheets that bridge the spaces between said spacer bodies and so to provide an air space between the undersurface of said inner sheet and upper surface of said outer sheet of sufficient size to receive air from said suction cups when said cups are pressed against an underlying surface prior to the moment when said seal is formed between said areas of said undersurface of said inner sheet and said surface presented by said necks and to permit an immediate inrush of air from said space as soon as said seal is broken.

2. An article of footwear according to claim 1 wherein said inner and outer sheets are sufficiently elastic and said spacer bodies are sufficiently spaced to permit stretching of said sole so that said holding means may be accommodated to feet and shoes that are substantially different in size.

3. An article of footwear according to claim 1 wherein said spacer bodies occupy not more than about 50% of the space between said inner and said outer sheets.

4. An article of footwear according to claim 1 wherein said spacer bodies are composed of compressible resilient material that is different from that of either the inner sheet or the outer sheet of said sole and is selected to provide the aforesaid properties of compressibility and resilience.

5. An article of footwear according to claim 1 wherein said holding means is composed of stretchable elastic material adapted to accommodate feet and shoes of different sizes.

6. An article of footwear according to claim 1 wherein said spacer bodies are isolated from each other so that said inner and outer sheets may be subjected to substantial lateral stretching without substantially stretching said spacer bodies.

7. In an article of footwear that comprises a sole and readily engageable and disengageable holding means for holding said sole underneath the sole of a human foot or of a shoe worn on the foot of a human, said sole presenting a plurality of suction cups depending from the bottom of said sole for improving the non-slip traction of said sole with respect to a surface against which said suction cups may be pressed, the improvement in that the sole of said article of footwear comprises a sheet of flexible elastic material, a plurality of flexible resilient suction cups secured to said sheet with said cups depending from the underside of said sheet, each of said cups comprising a neck that extends through said sheet so as to protrude substantially above the upper surface of said sheet and has a hollow passage extending therethrough, the upper extremity of each of said necks presenting a surface adapted to provide a seal for said hollow passage with a surface pressed thereagainst, and a plurality of spacer bodies upstanding from the upper surface of said sheet in secured relation therewith that are in laterally substantially spaced relation to the upper extremities of said necks and the upper surfaces of which are spaced from the upper surface of said sheet to an extent substantially greater than the spacing of the upper extremities of said necks from the upper surface of said sheet whereby a body presenting a surface that bridges said spacer bodies under pressure may become depressed into said sealing relation with said upper extremities of said necks and whereby upon relief of said pressure said spacer bodies tend to cause said surface to become separated from the upper extremities of said necks so as to rupture said sealing relation of said surface with the upper extremities of said necks.

8. An article of footwear according to claim 7 wherein the sole of the article of footwear consists essentially of said flexible resilient sheet provided with said suction cups and said spacer bodies so as to permit the establishment of sealing contact under pressure between the upper extremities of said necks and the sole of a bare human foot.

9. An article of footwear according to claim 8 wherein said suction cups and said spacer bodies are integral with said sheet and which comprises an upstanding beading integral with the border of said sheet.

10. An article of footwear according to claim 8 wherein said sheet having said spacer bodies in secured relation therewith is sufficiently elastic to accommodate feet of substantially different sizes.

* * * * *